US009295289B2

(12) United States Patent
James

(10) Patent No.: US 9,295,289 B2
(45) Date of Patent: Mar. 29, 2016

(54) WAIST-FASTENING, HIP-ENCOMPASSING APPAREL WITH AT LEAST ONE CONCEALED STORAGE COMPARTMENT

(76) Inventor: Leslie Jane James, Thousand Oaks, CA (US)

( * ) Notice: Subject to any disclaimer, the term of this patent is extended or adjusted under 35 U.S.C. 154(b) by 361 days.

(21) Appl. No.: 11/397,828

(22) Filed: Apr. 3, 2006

(65) Prior Publication Data

US 2006/0218690 A1 Oct. 5, 2006

Related U.S. Application Data

(60) Provisional application No. 60/667,037, filed on Apr. 1, 2005.

(51) Int. Cl.

| | |
|---|---|
| ***A45C 1/00*** | (2006.01) |
| ***A45C 1/04*** | (2006.01) |
| ***A41D 27/20*** | (2006.01) |
| ***A41D 1/04*** | (2006.01) |
| ***A45F 5/02*** | (2006.01) |
| ***A41D 15/00*** | (2006.01) |
| ***A41F 9/00*** | (2006.01) |

(52) U.S. Cl.

CPC *A41D 1/04* (2013.01); *A41D 15/00* (2013.01); *A41D 27/20* (2013.01); *A41F 9/002* (2013.01); *A45C 1/00* (2013.01); *A45C 1/04* (2013.01); *A45F 5/02* (2013.01); *A45F 5/021* (2013.01)

(58) Field of Classification Search

CPC ... A41D 27/20; A41D 27/205; A41D 27/201; A41D 1/002; A41D 1/14; A41D 2400/48; A41D 27/204; A41D 27/207; A41D 29/00; A45C 1/04; A45C 11/00; A45C 11/182; A45C 11/22; A45C 1/00; A45C 2001/022; A45C 11/321; A45C 2011/001; A45F 5/02; A45F 5/021; A45F 2005/006; A45F 2005/027; A45F 2200/055; A45F 5/022; A45F 2003/144; A45F 3/005; A41F 9/00; A41F 9/002; Y10S 224/904; Y10S 224/929

USPC ..... 2/48, 51, 52, 69, 92

See application file for complete search history.

(56) References Cited

U.S. PATENT DOCUMENTS

| | | | | | |
|---|---|---|---|---|---|
| 738,168 | A | * | 9/1903 | Delavoye | 2/253 |
| 2,263,538 | A | * | 11/1941 | Freirich | 2/51 |
| 2,317,176 | A | * | 4/1943 | Byrd | 2/48 |
| 2,474,495 | A | * | 6/1949 | Pollak | A45C 1/04 190/903 |
| 2,697,465 | A | * | 12/1954 | Johnson | 383/4 |
| 2,707,010 | A | * | 4/1955 | Armistead | A45C 1/00 109/53 |
| 2,955,292 | A | * | 10/1960 | McKend | 2/48 |

(Continued)

*Primary Examiner* — Bobby Muromoto, Jr.

(57) ABSTRACT

A valuables security-enhancing wrap-around apparel, comprising a wrap-around garment body made of flexible clothing material and having fastening means for releasably attaching the apparel securely around a wearer's waist, having a size and shape which when fastened to a wearer's waist substantially conceals and aesthetically covers portions of the wearer's hips, buttocks, upper legs and lower stomach, and comprising a rear apparel portion which extends downwardly in a freely-suspended manner past the wearer's buttocks to define an optimum or maximum concealed three-dimensional (3D) volume proximate to a rear upper region of the wearer's legs. Suspended from an interior portion of the apparel is at least one fully-concealed storage compartment having a three-dimensional storage capacity up to that of the 3D volume for securely storing and concealing valuables in an undetectable out-of-sight, out-of-mind manner, whereby the outer surface or exterior appearance of said apparel is not altered by any stored valuables.

24 Claims, 5 Drawing Sheets

(56) References Cited

U.S. PATENT DOCUMENTS 3,158,300 A * 11/1964 Withee ..... A45C 1/04 224/235
3,670,933 A * 6/1972 Jones ..... A45C 1/04 224/222
4,139,914 A * 2/1979 Tarr ..... A41D 27/20 2/247
4,201,259 A * 5/1980 Alsdorf ..... A45C 1/00 150/134
4,358,036 A * 11/1982 Maltais ..... A45F 5/02 224/163
4,461,030 A * 7/1984 Knudsen ..... A45C 1/04 2/22
4,749,113 A * 6/1988 Grubman ..... A45C 1/04 2/300
4,895,198 A * 1/1990 Samuelson ..... A45C 1/00 150/111
5,003,634 A * 4/1991 Brinkman ..... 2/46
5,060,835 A * 10/1991 Payne ..... 224/148.2
5,082,157 A * 1/1992 Emerson-Santos ..... A45C 1/04 224/587
5,165,115 A * 11/1992 Stanislaw ..... A41D 27/201 2/247
5,337,936 A * 8/1994 Blum ..... A45C 1/04 224/240
5,540,366 A * 7/1996 Coomber ..... A41F 9/002 224/587
5,551,496 A * 9/1996 Gray, Jr. ..... A45C 1/04 150/102
5,636,386 A * 6/1997 Salamone ..... A41D 1/14 2/211
5,678,620 A * 10/1997 Mayled ..... A45C 1/06 150/102
6,032,289 A * 3/2000 Villapiano ..... A41D 13/1245 2/102
6,971,566 B1 * 12/2005 Sartena ..... 224/576
8,104,654 B2 * 1/2012 Overton ..... A45F 3/14 224/581
8,453,898 B2 * 6/2013 Ewins ..... A45F 5/02 224/675
8,484,765 B2 * 7/2013 French ..... A41D 27/20 2/250
8,505,118 B2 * 8/2013 Bang ..... A41D 27/08 2/227
8,856,970 B2 * 10/2014 French ..... A41D 27/20 2/250
2001/0034890 A1 * 11/2001 Levas ..... 2/48
2002/0157170 A1 * 10/2002 Lipscher ..... A41D 27/205 2/250
2003/0014804 A1 * 1/2003 Morales ..... 2/92
2003/0178459 A1 * 9/2003 Aniwanou ..... A45C 1/04 224/587
2007/0051842 A1 * 3/2007 Pryor ..... A45C 11/182 242/378.3
2007/0084895 A1 * 4/2007 Bowen ..... A45C 1/04 224/660
2008/0208149 A1 * 8/2008 Vasquez ..... A61F 5/449 604/322
2009/0115615 A1 * 5/2009 Bleckmann ..... G08B 13/2434 340/572.8
2010/0065454 A1 * 3/2010 Badillo ..... A45C 9/00 206/320
2010/0205783 A1 * 8/2010 Bridgefarmer ..... A45C 11/182 24/21
2011/0016615 A1 * 1/2011 Massey ..... A41D 27/201 2/251
2011/0061146 A1 * 3/2011 Spiewak ..... A41D 1/002 2/227
2011/0203033 A1 * 8/2011 Rapp ..... A41D 27/201 2/227
2011/0314592 A1 * 12/2011 Wells-Chubb ..... A41D 27/20 2/247
2013/0191970 A1 * 8/2013 Foreman ..... A41F 9/00 2/300
2013/0325648 A1 * 12/2013 Kanner ..... A41D 27/205 705/26.5
2015/0296908 A1 * 10/2015 Clore-Gronenborn A41D 27/204 2/253

* cited by examiner

WAIST-FASTENING, HIP-ENCOMPASSING APPAREL WITH AT LEAST ONE CONCEALED STORAGE COMPARTMENT

CROSS-REFERENCE TO RELATED APPLICATION

The present application is a non-provisional patent application which relies on provisional patent application 60/667,037 filed on Apr. 1, 2005. The '037 application is hereby incorporated by reference as though fully set forth herein.

FIELD OF THE INVENTION

The present invention pertains generally to the field of apparel, garments and fashion accessories. More particularly, the invention is a wrap-around item of apparel or fashion accessory which wraps around one's waist and hips preferably as an auxiliary apparel item to cover the hips and buttocks area, having one or more fully-concealed storage compartments, and one or more quick-fastening means for securing the apparel to one's waist.

BACKGROUND OF THE INVENTION

Over the past few decades certain apparel items have gained popularity as an auxiliary or layered apparel item which assists in hiding or concealing much of the hips, buttocks and upper legs of the apparel wearer. In one case, the apparel is chosen by a wearer from among a group of long-sleeved apparel items such as a sweater, jacket, sweatshirt, or long-sleeved shirt, coat, and the like, and while not intended for being worn around the waist, these items, meant for covering the upper body are adapted to that purpose, by a wearer wrapping the apparel's two sleeves around the waist and tying them together. In this approach, the body of the sleeved item, hangs from the lower back of the wearer, for example, over a portion of one's pants, skirt, shorts, leotards or bathing suit, to conceal the area of the wearer's belly, hips, buttocks and upper legs. However, the most common method of tying the sleeves is to use a partial knot, because a fully knotted method is too bulky in appearance. Consequently, the sleeves often tend to not be sufficiently secured and frequently can come undone. This creates the annoyance of a wearer having to keep re-tying the sleeves so that the sleeved apparel will be adequately fastened around the waist. Additionally, the material of certain sleeved garments can often be too thick or heavy making the wearer uncomfortably hot or needlessly perspire. With the simulated sleeved-like garment embodiment of the present invention lighter, cooler materials can alternatively be employed.

In a second approach, female and male wearers have enjoyed the popularity and utility of sarongs to wrap around and cover much of the hips, buttocks and upper legs. The sarong material is often made of a sheer, lightweight material that is quite comfortable and attractive. However, a common method of tying the sarong is to also use a partial knot, a half hitch, or roll over, because a fully knotted method can appear too bulky. Consequently, the sarong can also tend to not be sufficiently secured creating the annoyance of a wearer having to keep re-tying the sarong so that it will be adequately fastened around the waist.

It is noted that sarongs often are produced in a limited range of sizes and therefore may not be suitable for larger men or women, however this is not a limitation of the present invention in that it is designed to be made in and accommodate an optimal range of sizes.

The present invention alleviates the annoyance of having to repeatedly re-tie the apparel to one's waist by providing one or more fastening means which solely, or in addition to the conventional tying method, positively secure the apparel to one's waist. Moreover, the invention's fastening means provide ample support for keeping the apparel securely fastened to the waist when items are secured within one or more hidden compartments. Additionally, the fastening means can be used to selectively cover a portion of a wearer's stomach area.

The conventional approaches described above, in spite of their inconvenient tying methods, have nonetheless become fashionable, particularly for women, because the wearing of skirt-like, or sarong-like, or sleeved apparel as described, provides a desired modesty, or a means to selectively control the exposure of a portion of one's pants, skirt, shorts, leotards or bathing suit, or an area of the wearer's hips, stomach, buttocks and upper legs. It is also noted that the wearing of the apparel as described can compliment the shape of the body in a flattering way, and that the tieable members of the apparel can be quite useful in covering part of the stomach or stomach region of clothing worn under the waist-fastening apparel.

In the case of using the apparel to control modesty or to selectively control a desired degree of exposure, it has become popular for woman taking a run, or a walk, or a hike, going sightseeing, or to a sporting or recreational event, or to a nightclub, or exercising on a treadmill or when in a gym, or going out publicly, or when running on one or more errands, to wear the sleeved-type apparel as described. However, in instances such as these, in addition to more effectively addressing the need of having apparel that is positively secured around the waist, it would also be advantageous to have apparel that could also easily carry items that are commonly needed when one goes out, and to preferably do so in a well-concealed manner that was also flattering to the shape of the body which the apparel covers.

For example, when exercising, travelling, sightseeing, shopping, or working or going outdoors, it could be helpful to securely carry in the apparel any one or more of the following commonly needed items: key(s), identification, a passport, a wallet, money, credit cards, makeup, a water bottle, a cell phone or other communication device, a portable audio device, a PDA, a GPS, a camera, and the like. Thus, the embodiments of the present invention eliminate the need of a wearer separately carrying a purse which can easily be lost or stolen when carried separately. Furthermore it would be advantageous for such items to be carried in a way that there would be minimal or no bulk added to the appearance of the apparel. However, conventional apparel have not adequately addressed such purposes. And consequently, they are ill-equipped to securely carry such items in a hidden or well-concealed manner and in a way that minimizes or eliminates the appearance of their bulk being added to one's clothing. Thus, the existing types of apparel have deficiencies, and a new type of apparel is needed to overcome these deficiencies. It is the purpose of the present invention to provide a new type of apparel which has the aforementioned, new benefits and advantages.

Numerous attempts have also been made at trying to improve waist-fastening 'fanny packs' which are meant to facilitate the transport of commonly carried personal items. However, many people consider them to be unattractive, or unaesthetic, or bulky in appearance and feeling, and in some cases thought of as an unwanted 'appendage.' They are not typically thought of as a fashion accessory rather, they have more of a utilitarian reputation. Other disadvantages include, that they are not flattering to one's figure or body shape; they do not conceal parts of the body that women wish to conceal;

in some cases there can be a social stigma associated with the fanny packs particularly if they are made of unaesthetic or gaudy material. Additionally, they do not hide the fact that someone may be carry valuable items on their person and may therefore invite unsafe consequences.

In contrast, the present invention provides a 'Cover & Carry' approach which conceals the fact that one is even carrying items that may be valuable, and also provides the concealing of areas of the body that women are interested in concealing while also doing do so in ways that can be flattering to the wearer's figure or shape and may even be considered quite stylish or trendy. As previously mentioned, the choice of materials used to make the waist-fastening apparel and any embellishments thereto, are extremely broad and can chosen from any of the materials and embellishments used in the past for making other types of apparel, garments and recreational clothing. Machine washable and/or dry-cleaned materials can include, but are not limited to, current or seasonal colors and/or patterns that are in fashion, fashion-forward materials, or embellishments, or both, keeping up with the trends in fashion, or selected among color palettes currently in fashion or projected to soon be in fashion, or selected from sheer material, texture, velour, corduroy, leather, denim, lightweight material, semi-transparent, translucent or opaque materials, or materials well suited for sportswear, athletic or exercise wear, swimwear, fashion accessory, resort or recreational garments, evening attire, or selected from material that is well-suited for coordinated fashion accessories, and the like, or any combinations thereof. Some examples of a few of the embellishments available from a very broad range of choices include, but are not limited to the use of one or more studs, sequins, grommets, appliqués, patches, and anything that can be embroidered, stitched into, onto, or adhered onto the apparel including the employment of such items as one or more detail.

BRIEF SUMMARY OF THE INVENTION

The present invention is a waist-fastening, hip-encompassing garment or valuables security-enhancing wrap-around apparel which can be comprised of any apparel material, or apparel elements or embellishments typical of those employed on or used in the making of apparel to date. The apparel has one or more well-concealed or hidden storage compartments such as a pocket, a pouch or other enclosure having at least one opening which preferably includes separable fastening means for positively closing the opening to secure one or more items carried in the compartment(s). The one or more hidden storage compartments are located within a (3D) storage volume, or an optimal or maximum three-dimensional (3D) storage volume, having a height dimension extending upwardly from a lower end of a rear apparel portion to a point proximate to a rearward-most portion of the wearer's buttocks, a width dimension up to that of the width of the wearer's buttock's, and a depth dimension being defined between a lower inward-facing interior surface of the rear apparel portion and rearward-facing surface contours of the wearer's body below a rearward-most portion of the wearer's buttocks. Suspended from an interior portion of the wrap-around garment body is one or more fully-concealed storage compartments having a three-dimensional storage capacity up to that of the 3D volume for securely storing and concealing valuables within the 3D volume in an out-of-sight, out-of-mind manner, and whereby the outer surface or exterior appearance of the apparel is not altered by any stored valuables An apparel lower portion is comprised of apparel material, and as needed or desired apparel elements or embellishments, such as those used for any in of a variety of conventional apparel items, and is sized and shaped so that a wearer can cover the buttocks, an upper rear portion of the legs, the hips and a portion of the stomach area. Attached adjacent to an upper edge of the apparel lower portion is a waistband-like member which at opposite ends has tieable members which extend outwardly and independently from the apparel lower portion and can be tied by a wearer in a conventional fashion. The apparel is sized and shaped such that, when the apparel is fastened around the waist, it has the likeness of a skirt, or a sarong, or a sleeved apparel (fastened at the waist). Preferably, various embodiments of the invention provide a purse-in-a-skirt (i.e., waist-fastened apparel with integral purse or wallet), purse-in-a-sarong, or sleeved apparel like purse-in-a-garment type of utility.

Attached to an interior surface of the garment is an auxiliary interior waistband or strap which at opposite ends has auxiliary fastener members such as one or more straps which preferably extend beyond the ends of the waistband having separable fastening means attached to the members for positively securing the apparel to the waist of a wearer in a belt-like manner. Also attached to, or fabricated integrally with, the interior surface of the apparel is one or more hidden, or well-concealed, apparel compartments, such as a purse-like compartment, or a pouch, or a pocket, and the like. Optionally, the compartment(s) can be permanently attached, or separably fastened, adjacent to an interior surface of the apparel lower portion or to a portion of, or edge of, either the waistband-like member or auxiliary interior waistband. Preferably at least one compartment is centrally located, sized and shaped such that it extends downward in a manner to hang freely so that, when the apparel is worn, items contained within the compartment will be concealed and positioned in a region proximate to the wearer's lower buttocks and upper rear portion of the legs. When so extended, items in the compartment are suspended in a space formed behind the rear upper legs of the apparel wearer and an interior surface of the apparel, such that one or more storable items like a wallet, credit card and keys are easily concealed in the compartment and their shapes or combined bulk are not noticeable to one or more observers of the wearer. This hidden compartment(s) feature of the present invention provides new and improved security advantages with its hidden 'out of sight-out of mind' approach. The combination of the waistband and belt-like elements serves to fasten and secure the apparel to the waist and to also do so in a secure enough manner which easily accommodates the weight of any items that are carried in one or more hidden compartments.

For even greater security, preferably the opening of the compartment has means for securing items within the compartment such as a zipper or other separable fastening means commonly employed on pockets, pouches or other enclosures of apparel or garments, such as one or more hook and loop fasteners, buttons, snaps and the like. Thus when the centrally located hidden compartment is concealed and its opening is positively secured, a new and improved type of security for apparel is provided which can be highly effective in reducing the incidences of pick-pocketings, purse snatchings and related crimes such as assaults. This can provide the added benefit of making it safer for the wearer of such improved security apparel, particularly women, because a would-be assailant would have no way of knowing that the apparel wearer is carrying anything of value. Additional security is provided by the purse-like hidden compartment being an integral part of the apparel in that the purse is will not accidentally be left behind, as is too often the case with a typical purse, for example, when someone leaves their purse at a table or other public place, because they were distracted, or too busy. With the purse-compartment being part of the apparel, wherever the person/apparel goes, the purse goes as well.

In another embodiment of the invention, the apparel has the appearance of a sleeved-like garment having a garment body consisting of commercially available apparel material sized and shaped approximately to that of a sleeved garment portion that would cover the torso of a wearer. The garment body (torso-body portion) has two outwardly extended sleeve-like members attached adjacent at opposite upper edges to create the appearance of sleeves, such that the combination of the faux body and sleeves give the appearance of an actual sleeved garment. Optionally, the garment body can also include a simulated collar portion fashioned adjacent to, or integrally with, an upper central portion of the body. Thus the combined elements create the look of a conventional sleeved garment which is also tieable around a wearer's waist either by the faux sleeves and/or by the combination of an auxiliary interior waistband and fastening means.

In another embodiment, one or more storage compartments, and optionally, auxiliary waist-fastening means, can be adapted to actual sleeved apparel by providing fastening means for connecting these elements to one or more locations on the sleeved apparel. Preferably, the fastening means is selected from among a group of apparel fastening elements, clothing fasteners, and separable fasteners commonly employed on garments that have attachable auxiliary items such as a hood, collar, or sleeves and the like. For example, an edge portion of one or more apparel component(s) e.g., attachable compartment(s), or combination waist-fastening means and compartment, or any of the apparel components previously described, can be equipped with one half of a toothed zipper element attached adjacent to the edge, and a second-half toothed zipper element can be attached adjacent to the sleeved apparel at a location where the first zipper element is meant to be attached. In operation, the two toothed zipper halves are aligned together by a wearer such that zipper slider element then aligns and urges the two toothed zipper halves together in a typical zipper manner. When the zipper slider has been moved from one end of the zipper halves to an opposite end, the zipper is then fully joined, and the respective apparel component(s) such as any one or more of the following (i) an attachable compartment, or (ii) combination waist-fastening means and compartment, or (iii) auxiliary interior waistband with auxiliary extended members having attachment means attached to the members, are then separably fastened to the apparel at the desired location. Such items can be quickly removed from the apparel by reversing the zipper slider until the two toothed zipper elements completely separate.

While the type of separable fastener described in the previous example consists of a zipper, it is herein noted that any in a variety of other clothing fastening means, or separable fasteners, can alternatively be employed.

It is also noted that one or more storage compartments, such as pockets or pouches and the like, can alternatively be located on external surfaces of apparel or garments in places that are in plain view and depending on how the opening of the compartment(s) are orientated, can optionally be free of any separable fasteners. For example, a pocket having an opening which is orientated in a substantially horizontal manner, and having pocket material which extends downward from the opening, may not require a pocket opening fastener in order to secure items in the pocket, in which case it can be preferable to make the pocket without one or more fasteners. Additionally, one or more pocket openings, whether located on internal or external surfaces of the apparel, can have a variety of sizes, shapes, appearances and embellishments, including having the appearance of a simple slit in the apparel material.

Any embodiment of the present invention can be made out of any of the materials from which typical apparel is comprised. Preferably the invention is comprised of materials which make the apparel a coordinated fashion accessory. For example the apparel material can be selected from, and match, the types of materials used for athletic attire when the wearing of the apparel is meant to be coordinated with athletic clothing. A similar approach can be taken with any in a variety of other categories of clothing, including but not limited to: swimwear, sportswear, evening wear, attire having a 'dressy' look, leather wear, denim clothing, seasonal clothing, recreational or camping/hiking/camouflage attire, and so forth. Alternatively, the apparel can be comprised of complimentary or contrasting materials.

Additionally, the apparel of the present invention can be made out of water resistant or water-proof material to provide a water protective shield, allowing a wearer to sit on wet surfaces without getting her or his clothes wet. In operation, a rear outer portion of the apparel material, which normally extends downward from the waist, will first come into contact with the upper surface of a wet seating area, and thereby keep the wet surface from contacting the apparel wearer's clothing. The choice of material used in the present invention can also include the incorporation of a lightweight cushioning material which can optionally be made long enough to be folded into two or more layers to provide more comfort to a wearer when seated, particularly when sitting on a hard surface.

In another embodiment of the invention, a portion, or a substantial area, of the apparel can include a material which incorporates or functions as one or more heating, or cooling pads. The material having heating and/or cooling features or properties can be accomplished in a number of currently ways, including but limited to, the incorporation of material, or elements or components within the material: (1) having electronic heating and/or cooling utility including the options to provide electrical power to the electrical components by either attaching a power cord between one or more apparel components to an external AC or DC power supply, or to a transportable power supply which is carried by the wearer e.g., one or more batteries which are preferably concealed in a hidden or well-concealed apparel compartment; (2) containing chemicals which provide heating and/or cooling from one or more chemical reactions or interactions; (3) having heat or cold retaining properties, or (4) having the means to store and to preferably evenly distributing a heated or cooled fluid, such as water.

BRIEF DESCRIPTION OF THE DRAWINGS

FIG. 5 also shows an optional retention means for holding a beverage container.

DETAILED DESCRIPTION OF THE PREFERRED EMBODIMENTS

Figure 7:
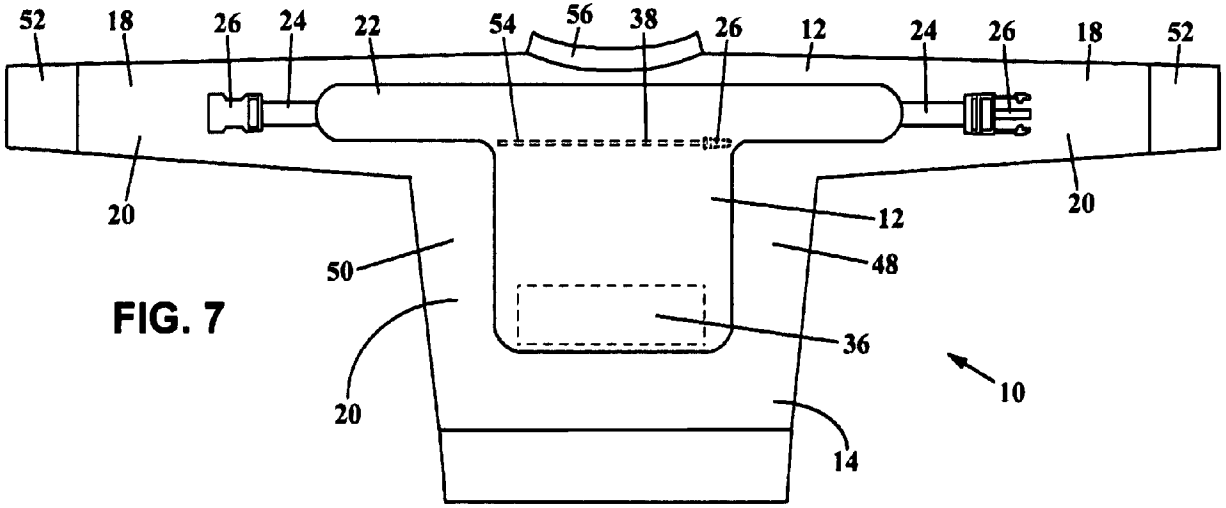
FIGS. 7 and 8 are interior and exterior two-dimensional views respectively of the waist-fastening apparel of the present invention having the appearance of a sleeved-like garment. The interior view of FIG. 7 shows a compartment for the storage of transportable items attached adjacent to a lower edge of a waistband-like member which has fastening means for securing the apparel to one's waist. The exterior view of FIG. 8 shows the compartment, stored item(s), waistband-like member and fastening means in dashed lines to indicate a positioning of those components on the opposite side of the apparel.
Figure 8:
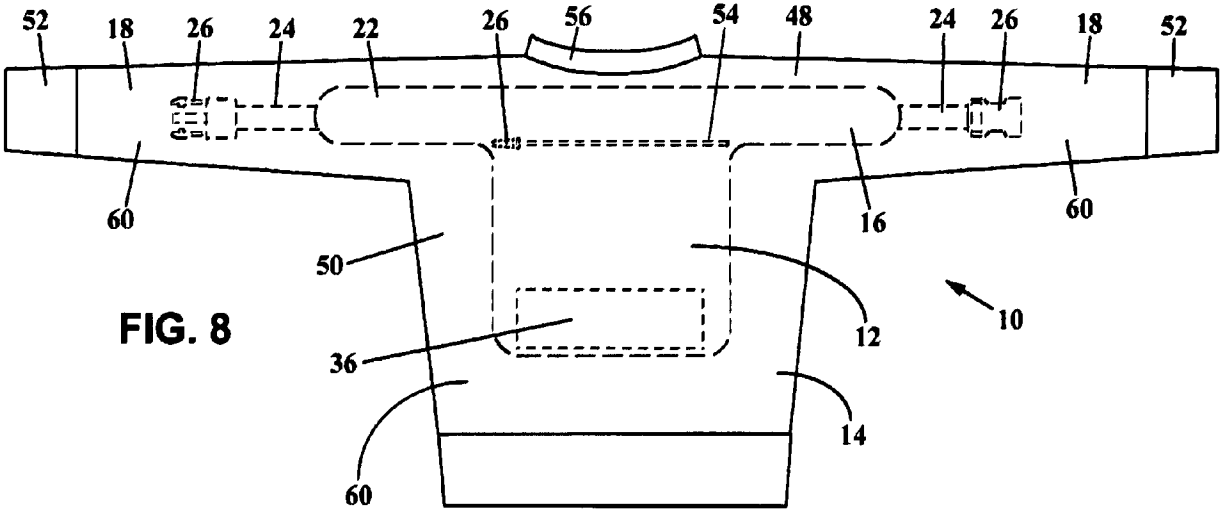

To facilitate an ease-of-understanding of the inter-relatedness of several of the drawing figures, it is noted that a number of the reference numerals have been duplicated. In references to FIGS. 1 and 2 interior and exterior two-dimensional views respectively depict a skirt-like or sarong-like embodiment of the waist-fastening apparel 10 of the present invention. FIGS. 7 and 8 are interior and exterior two-dimensional views respectively of a sleeved-like garment 48 embodiment of the waist-fastening apparel 10 of the present invention, or FIGS. 7 and 8 alternatively depict embodiments incorporating conventional apparel. In each case, a pouch-like or purse-like hidden storage compartment 12 is depicted being suspended from an interior portion of the apparel and by way of example is shown having an upper portion attached to a lower portion of a waistband-like member 16, or alternatively can be attached to a lower portion of an auxiliary interior waistband 22. Preferably, one or more of the storage compartments 12 are suspended from an interior portion of the apparel within an optimum or maximum storage volume 80 (depicted in FIGS. 13A-13G), and thus configured, are ideal for transporting one or more storable items 36 in a concealed manner hidden behind the exterior surface 60 of the wrap-around garment. As can be seen in FIGS. 13A-13G, and will be described later in greater detail, the invention provides an optimal or maximum storage volume 80 in which one or more hidden storage compartments 12 can be suspended to conceal items and/or valuables in a confidential manner so that the external surface of the apparel is not altered or affected by the bulk of the stored items. The three-dimensional (3D) volume or space is created between the interior-facing surface of a freely suspended apparel rear portion 76 and the rearward-facing portions of the wearer's lower body below a rearmost portion of the buttocks 74. Thus, the invention provides an apparatus and method which take advantage of the naturally-occurring shape and surface contours of the human body below the buttocks and above the knees to provide a substantial volume in which to conceal one or more enhanced-security hidden compartments 12 in an out-of-sight/out-of-mind manner.

For example, in reference to FIGS. 1, 2, 7 and 8, an upper edge portion of a hidden compartment 12 is depicted being attached adjacent to a lower edge of a auxiliary interior waistband 22 which in turn is either permanently attached or attached by a separable fastening means 46 (illustrated in FIGS. 1 and 2) adjacent to a lower edge portion of waistband-like member 16. Alternatively, one or more hidden compartments 12 can be attached and/or suspended from a different portion of interior surface 20 of the apparel and be positioned within, and/or sized having a dimension in a height, depth or width up to that of, the maximum storage volume 80 (depicted in FIGS. 13A-13G). Thus, the storable item(s) 36 depicted in the plan views of FIGS. 1, 2, 7 and 8 are readily concealed in an out-of-sight/out-of-mind within the aforementioned storage volume when the warp-around waist-fastening apparel 10 is secured to a wearer's waist.

Figure 1:
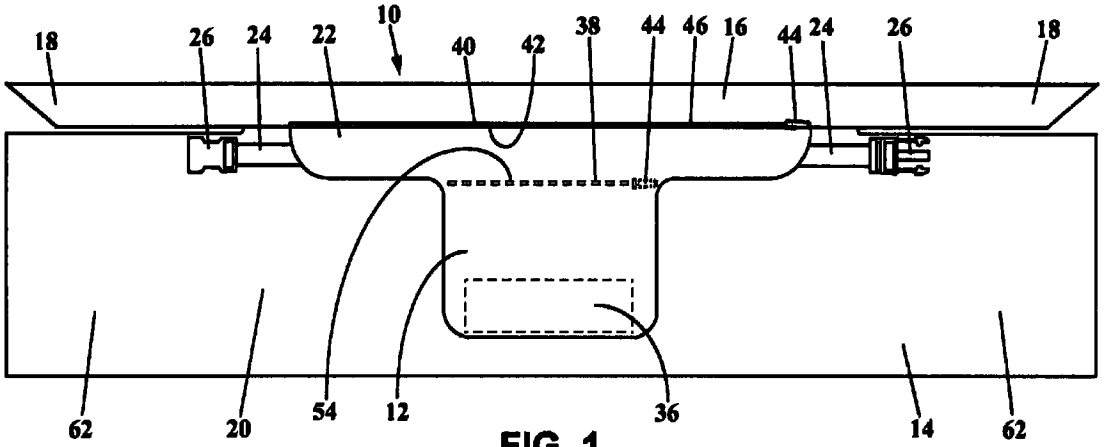
FIGS. 1 and 2 are interior (inside) and exterior (outside) two-dimensional views respectively of the waist-fastening apparel of the present invention. The interior view of FIG. 1 shows a compartment for the storage of transportable items attached adjacent to a lower edge of a waistband-like member which has fastening means for securing the apparel to one's waist. The exterior view of FIG. 2 shows the compartment, stored item(s), waistband-like member and fastening means in dashed lines as a means for indicating a positioning of those components on the opposite side of the apparel.

While the separable fastening means 46 in FIG. 1 is shown being comprised of a zipper 38, consisting of a zipper first half 40, a zipper second half 42 and a zipper slider 44, it is herein noted that any among a variety of fastening means employed on or used in the making of apparel, garments and recreational clothing may instead be used. For example, one or more of the previously mentioned attachable components can alternatively be separably attached to an interior surface of the apparel 10 by one or more fasteners selected from the group consisting of: conventional apparel fastening means, fastening means providing adjusting means for lengthening or shortening the operative length of the waistband-like member, fastening means providing adjusting means for loosening or tightening the waistband-like member, zipper fastening means, ties, cords, knots, partial knots, hitches, hooks, latches, grommets, keepers, straps, strap adjusting elements, elastic components, hook-and-loop fasteners, button-in-button-hole fasteners, clips, clasps, clamps, snaps, belts, buckles, loops, chains, rings, interlocking elements, threaded elements, separable fastening means employed on conventional apparel, and fastening means also having adjusting means for adjusting the length of the waistband-like member to which the fastening means is attached whereby the fit of the apparel around the wearer's waist is adjusted, and the like.

The compartment(s) 12 can have any in a variety of sizes and/or shapes and preferably have at least one opening equipped with a fastening means such as a zipper 38 having a zipper slider 44, for securing items safely in the compartment(s). Preferably, the opening(s) on the compartment(s) is located so as to provide optimal ease-of-access to the wearer of the apparel. For example, the zipper 38 may be located near an upper outward-facing portion of the compartment such that when the wearer wishes to store or retrieve any items, he or she simply rotates the apparel partially about his or her waist and raises the skirt-like member of the apparel (shown in FIGS. 1 and 2) upward to reveal and provide easy access to the opening, or optional opening having the zipper or other separable fastening means. When the wearer wishes to return the compartment(s) to its previous concealed position, he or she simply lowers the compartment(s), optionally secures any compartment fasteners, lowers the apparel material over the compartment(s), and rotates the apparel about his or her waist until the compartment(s) is positioned within the aforementioned storage volume.

These steps can be described as a method for providing valuables security-enhancing wrap-around apparel and releasably fastening the apparel around the waist of a wearer, comprising the steps of: (1) sizing and shaping to a prospective wearer size, a wrap-around garment body made of at least one layer of flexible clothing material to substantially conceal and aesthetically cover portions of the prospective wearer's hips, buttocks, upper legs and preferably a lower stomach region; (2) adjoining apparel fastening means to the wrap-around garment body; (3) determining a substantial, concealed three-dimensional (3D) volume between a rear lower portion of the apparel and proximate to a rear upper region of the wearer's legs; (4) determining a size and shape of at least one fully-concealed compartment up to that of the 3D volume; (5) making one or more fully-concealed compartments and suspending it from an interior portion of the wrap-around garment body at a location wherein valuables, when stored in the fully-concealed compartment(s), will be located within a region of the 3D volume in an out-of-sight, out-of-mind manner; (6) wrapping the wrap-around garment body and the apparel fastening means around a wearer's waist with one or more fully-concealed compartments located in a region within the 3D volume, and engaging the apparel fastening means to secure the wrap-around apparel to the wearer's waist; and (7) when the wearer subsequently wishes to remove the wrap-around apparel, disengaging the apparel fastening means to remove the apparel from around the wearer's waist.

The aforementioned method may include additional or optional steps, for example by additionally or optionally comprising the steps of: (1) determining a concealed three-dimensional (3D) maximum volume between a rear lower portion of the apparel and proximate to a rear upper region of the wearer's legs; (2) determining a size and shape of at least one fully-concealed compartment up to that of the maximum compartment volume; (3) and making one or more fully-concealed compartments and adjoining a portion of the compartment(s) to an interior portion of the wrap-around garment body at a location wherein valuables, when stored in the compartment(s), will be located within a region of the 3D maximum volume in an out-of-sight, out-of-mind manner.

In another embodiment of the present invention waist-fit adjusting means are provided whereby the fit of the apparel around a wearer's waist can be tightened or loosened by the wearer making adjustments to one or more adjusting means. For example, waistband-like member 16 can be elongated having opposite ends that are adapted to provide tieable members 18 as depicted in FIGS. 1 and 2, or FIGS. 7 and 8 being comprised of actual sleeves or faux sleeves. In operation, the wearer wraps the waistband-like member 16 tightly and ties tieable members 18 together for example using a 'roll-over', or half-hitch, or other knot, to achieve a tightened waist-fit. To achieve a looser fit, the wearer can simply loosen the knot or re-tie the tieable members 18 in a looser fashion to increase the effective length of the waistband-like member 16. Alternatively, a waist-fit adjusting means can consist of fastening means 26 having strap-length adjusting means located at opposite ends of the waistband-like member 16 whereby the wearer can adjust the effective or operative length of waistband-like member 16 by adjusting the length of one or both straps. In a third approach both the tieable members 18 and the fastening means 26 can be employed for example, when a wearer first fastens the ends of a waistband-like member 16 and then ties tieable members 18 together such that the latter conceals the former to create the appearance of a convention article of clothing which is informally tied to one's waist.

In each case, a loosening of tieable members 18, or an increase to the effective length of a waistband-like member 16, or both, creates a loosened fit of the apparel about the wearer's waist such that the wrap-around garment can then easily be rotated about the waist as needed to provide wearer-access to one or more hidden compartments 12 or a re-positioning of the compartment(s) to a former position within the storage volume defined proximate to the wearer's rear upper legs.

The procedure can be described in a sequence of steps as a method whereby a wearer rotates the apparel to access one or more of the hidden storage compartments 12 and subsequently covers the compartment(s) with a portion of the apparel and returns the compartment(s) to a position within the 3D maximum volume.

For example, a method wherein a wearer-accessing, and subsequent concealing, of one or more fully-concealed compartments is facilitated, comprising the steps of a wearer: (1) adjusting apparel fastening means to loosen the fit of the apparel around a wearer's waist, and rotating the apparel about the waist until the fully-concealed compartment(s) can be revealed beneath the flexible clothing material and easily accessed by the wearer, and when the wearer subsequently wishes to return the compartment to a fully-concealed condition, (2) re-covering the compartment with the flexible clothing material and rotating the apparel about the waist until the fully-concealed compartment is located within a region of the compartment volume in an out-of-sight, out-of-mind manner, and adjusting the apparel fastening means to re-tighten the fit of the apparel around the wearer's waist.

Since, embodiments of the present invention have a substantial storage capacity available within the maximum storage volume 80 (FIGS. 13A-13G) which can optionally be exploited, it is possible to provide new types of wrap-around garments having one or more internally-concealed compartments which have a capacity approximating that of a large wallet or a small to medium-sized purse whereby the apparel provides an entirely concealed purse-in-an-apparel utility for example, selected from the group consisting of: a purse-in-a-wrap, a purse-in-a-sarong, a purse-in-a-skirt, a purse-in-a-sweatshirt, a purse-in-a-coat, a purse-in-a-jacket, and a purse-in-a-shirt. As previously mentioned, such purse-in-an-apparel utility can be achieved so that the collective bulk of one or more items stored in the compartment(s) will not affect the appearance or alter the exterior surface of the apparel and the valuables will be concealed in an out-of-sight/out-of-mind manner.

Figure 2:
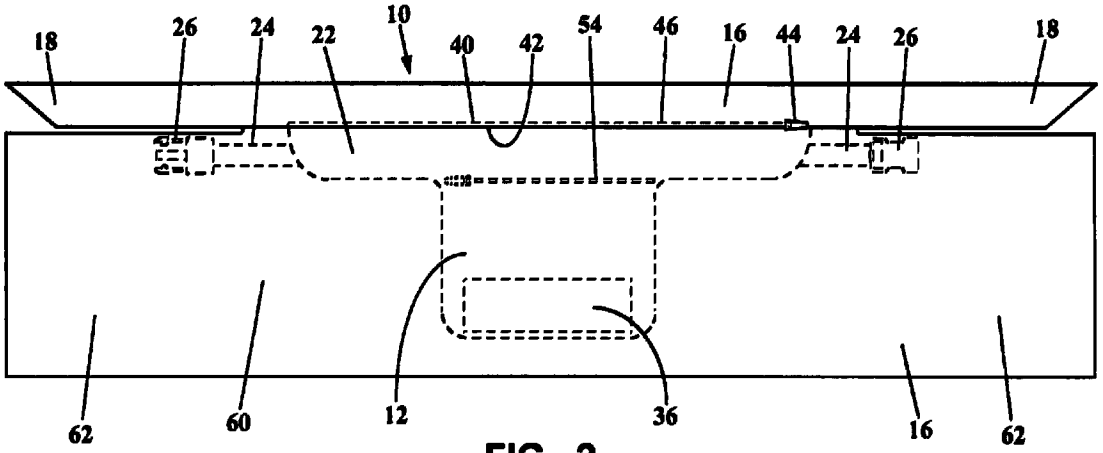

In the embodiment illustrated in FIGS. 1 and 2, the apparel fastening means 26 are depicted each being attached adjacent to an end of an auxiliary fastener member 24 and the latter is preferably equipped with easy adjustment means such as a strap-length adjusters for increasing or decreasing the operative length of member(s) 24 as needed or desired by a wearer of the waist-fastening apparel 10. Such adjustments can allow for a slip-fit around the waist, for example, to facilitate rotation of the apparel for easy to one or more compartments. Moreover, such easy adjustments of the waist-fastening means readily accommodates the gaining or losing of weight of a wearer of the apparel. To simulate the look and functionality of a skirt-like or sarong-like apparel, the waistband-like member 16 is preferably elongated with each opposite end adapted to accommodate tieable members 18 which extend outwardly beyond an upper edge of apparel lower portion 14.

With embodiments of the invention including both the tieable members 18 and separate fastening means 26 (and optionally any auxiliary fastener members 24), preferably, the tieable members 18 are located to extend outwardly from the apparel such that when they are tied together, they conceal auxiliary interior waistband 22, auxiliary fastener members 24 and fastening means 26. In combination, the latter components bear the weight of the apparel and any storable items transported in one or more compartments. Thus the unburdened tieable members 18 will tend to remain tied until a wearer of the apparel wishes to untie them, eliminating a common annoyance associated with sleeved garments which bearing all of the weight of the garment easily come untied from a wearer's waist.

While lower portion 14 is depicted in FIGS. 1 and 2 as having a rectangular shape, it is herein noted that any among a variety of alternative shapes can instead be employed and sufficient coverage of the buttocks, upper rear legs, hips and the like can otherwise be provided. Additionally, one or more perimeter edges of the apparel can be shaped differently than the straight edges shown. One or more edges, or surfaces, or interior components, or any combination thereof, of the apparel can be textured, pleated, embellished, and/or made of alternative, complimentary or contrasting material. While the exterior surface 60 of the apparel 10 is shown having no embellishments, it is herein noted that any among a variety of apparel embellishments such as those previously mentioned may be employed.

In another embodiment of the invention, a portion of the apparel further includes advertising, which may include, and is not limited to, the name or indicia of a health club, resort or gym, or the brand name of an apparel maker. For example, the largest contiguous surface of the waist-fastening apparel is the portion which drapes over the lower back, buttocks and upper legs of a wearer. This portion can easily be seen by observers, including at a distance, when a wearer of the apparel is faced away from, or is walking away from the observer. Thus, it would be advantageous for advertising, promotional or cross-promotional purposes to have one or more type of indicia placed in this area, or any other area of the apparel that is easily viewable by one or more observers when the apparel is worn by a wearer. Preferably any indicia written in a readable language, appears on the apparel in a right-reading orientation.

The exterior view of FIG. 2 shows the compartment 12, stored item(s) 36, waistband-like member 16 and fastening means 26 in dashed lines as a means for indicating a positioning of those components on the opposite/interior side of the apparel, the components are not viewable from the exterior side of the apparel.

Figure 4:
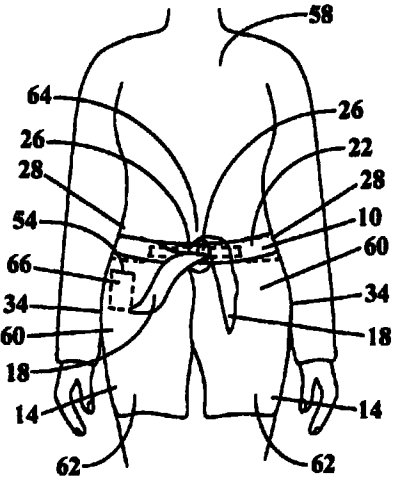
FIG. 4 is a two-dimensional front view, similar to that of FIG. 3 wherein the tieable members have been pulled taught around the hips and waist of the wearer and tied, causing lower skirt-like members to come together to create the appearance of a skirt-like or a sarong-like apparel. In an upper left portion of the apparel shown in FIG. 4 an auxiliary pocket-like compartment is also shown.
Figure 3:
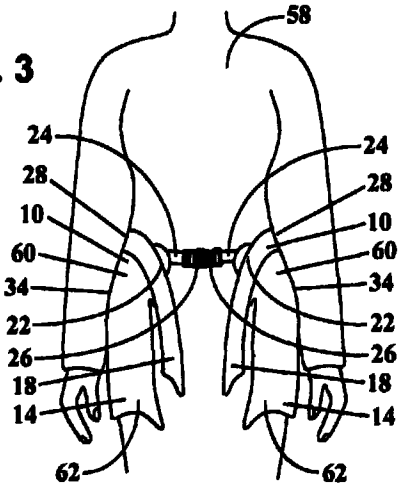
FIG. 3 is a two-dimensional front view of a skirt-like or sarong-like embodiment of the invention as it would appear secured to the waist of a wearer by the invention's fastening means, before the tieable members of the apparel have been tied.
Figure 5:
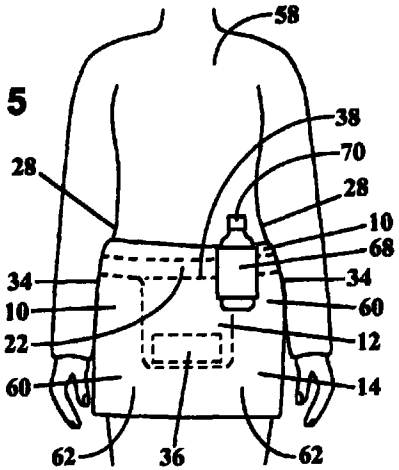
FIG. 5 is a two-dimensional rear view of the apparel and apparel wearer depicted in FIG. 4. The compartment, stored item(s), waistband-like member and fastening means shown in dashed lines in FIG. 2 are similarly depicted in FIG. 5 as a means for indicating a positioning of those components on the opposite, interior side of the apparel.

In operation with a preferred embodiment, a wearer of the apparel 10 will typically center the auxiliary interior waistband 22 with the lower back at the height of the waist 28 as shown in FIG. 5. Or, will center and connect the fastening means 26 in a central area of the belly as depicted in FIG. 3 (or central area of the stomach 64 as shown in FIG. 4). Preferably, he or she will have adjusted the length of the auxiliary fastener member(s) 24 as needed so that when the fastening means 26 are secured, the apparel will be comfortably fastened at the waist. Next, the wearer will take the two tieable members 18 and secure them together as shown in FIG. 4, preferably in a customary manner over the fastening means 26 and over the ends of the fastener member(s) 24 if needed, such that the latter components are covered by portions of members 18 and are obscured from sight. One or more auxiliary compartments 66 can be added to the apparel 10 as shown in FIG. 4 and can have a pocket-like opening, or an opening with separable fastening means, and the opening can be accessible from an exterior surface 60 or interior surface 20 of the apparel. Additionally, such compartments can be made in any in a variety of sizes and/or shapes.

Preferably adjustments made to the length of the auxiliary fastener member(s) 24 are such that when the fastening means 26 are secured together, there is sufficient play between the auxiliary interior waistband 22 and the wearer's waist, and/or an optional elasticity to the waistband material to provide quick access to, or a re-centering of, one or more hidden compartments by rotating the apparel partially around the wearer's waist. To quickly remove the apparel when desired, the wearer simply unties members 18 when only members 18 are employed as fastening means, or unties members 18 and separates fastening means 26 when both are employed. Preferably means 26 are equipped with a quick-release and/or quick-attaching mechanism(s). As previously mentioned, fastening means 26 may be comprised of any among a variety of fastening, or belt-like or waist-tying elements typically employed with apparel, garments and recreational clothing.

FIGS. 1 and 2 also depict optional dual-purpose or multi-purpose embodiments of the apparel wherein auxiliary interior waistband 22 auxiliary fastener members 24 and fastening means 26, or any combination thereof, can be separably fastened to the apparel, and can be selectively removed to provide several options: (1) to provide an improved type of sarong-like or skirt-like apparel having independently operable tieable members 18; (2) to provide exchangeable/attachable components that can be fastened to other sarong-like or skirt-like apparel that are optionally sold without the interior components and are equipped with fastening means which accept, or are correctly matched with or respectively to, the fastening means of the exchangeable components; (3) to provide a means whereby one or more portions or components of the apparel can be washed or dry-cleaned separate from one or more other components; and (4) to provide a means whereby a wearer can optionally employ the waistband 22, auxiliary fastener members 24 and fastening means 26 in a 'fanny pack' type of manner without the skirt-like or sarong-like apparel portion. In the latter case, a valuables security-enhancing wrap-around apparel is comprised of a waistband-like member being attached to at least one storage compartment and so as to be wearable separate from the wrap-around garment body, while also being releasably attachable when desired to the wrap-around garment body by releasable fastening means, wherein the releasable fastening means are selected from the group consisting of: conventional apparel fastening means, zipper fastening means, ties, cords, knots, partial knots, hitches, hooks, latches, grommets, keepers, straps, strap adjusting elements, elastic components, hook-and-loop fasteners, button-in-button-hole fasteners, clips, clasps, clamps, snaps, belts, buckles, loops, chains, rings, interlocking elements, threaded elements, and separable fastening means employed on conventional apparel.

FIG. 3 is a two-dimensional front view of a skirt-like or sarong-like embodiment of the invention as it would appear secured to the waist 28 above the area of the hip 34 on a female body 58 by optional fastening means 26, before the tieable members 18 of the apparel 10 have been tied. In FIG. 3 the tieable members 18 and skirt-like portion 62 are shown hanging downward prior to a tying of members 18.

FIG. 4 is a two-dimensional front view, similar to that of FIG. 3 wherein the tieable members 18 have been pulled taught around the waist 28 above the area of the hip 34 on a female body 58 and tied so as to conceal optional fastening means 26 and cause lower skirt-like portions 62 to come together to create the appearance of a skirt-like, sarong-like or conventional apparel. FIG. 4 further illustrates how one or more auxiliary compartments 66 can be incorporated into the apparel 10 and have a pocket-like opening, or an opening with separable fastening means, and the opening can be accessible from an exterior surface 60 or interior surface 20 of the apparel. Additionally, such compartments can be made in any in a variety of sizes and/or shapes, including those which will best accommodate items intended to be stored therein for example items selected from the group consisting of: exercise monitoring apparatus, cell phones, PDA apparatus, GPS apparatus, personal identification, credit cards, keys, wallets, purses, traveler checks, money, change, grooming-related goods, admission tickets, and coupons.

FIG. 5 is a two-dimensional rear view of the apparel and apparel wearer depicted in FIG. 4. The largest contiguously shown surface of the waist-fastening apparel is depicted in FIG. 5 and is the rear apparel portion which extends downwardly in a freely-suspended manner past the wearer's buttocks to define a concealed three-dimensional (3D) volume proximate to a upper rear portion of the legs 32 (see also FIG. 6) of a wearer. A hidden storage compartment 12, stored item(s) 36 and waistband-like member 22 are shown in dashed lines indicating a positioning of those components on the opposite, interior side of the apparel relative to the upper rear portion of the legs 32 (also shown in dashed lines in FIG. 6). These components, also shown in dashed lines in FIGS. 7, 8, 10, 11 and 12, are not viewable from the outside of the apparel 10.

Optionally, the apparel may include a beverage container securing means 68 for releasably fastening a beverage container 70 to the apparel. For example, securing means 68 can be comprised of an elastic band of material or stretchable material having sufficient elasticity to securely retain a beverage container while a wearer is walking, running or playing a sport. Preferably both ends of the band are attached adjacent to an outer surface area of the apparel at a location which provides ease of access to beverage container 70 while also being positioned conveniently out of the way of one's arm or leg movement while the wearer is walking, running or playing a sport. Preferably the elastic band forms a loop of material having a matching or coordinated appearance with that of the apparel, and having an opening (inner diameter) within the formed loop that is smaller in diameter than the outer diameter of the container, such that the latter is held snuggly and positively within the elastic band until it is removed when desired by a wearer. Alternatively, one or more other types of container securing means can be used, for example: (1) a beverage container holder having one or more releasable fastening means for securely retaining a beverage container in the beverage holder and for quickly releasing it therefrom as desired, (2) and a beverage container holder which is separably fastened to an outward-facing surface of the apparel 10 e.g., by any one or more of the apparel-related fastening means previously described.

Figure 6:
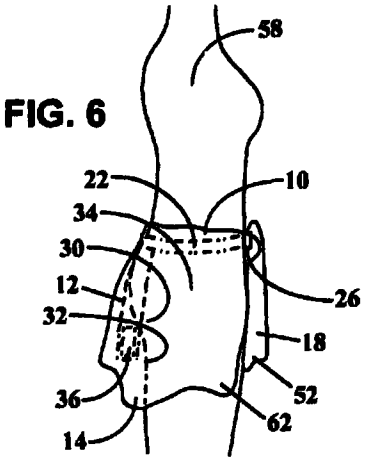
FIG. 6 is a side view of the apparel as worn by the apparel wearer in FIGS. 4 and 5. A compartment, stored item(s), waistband-like member and fastening means are depicted in dashed lines as a means for indicating a preferred positioning of those components. In an upper right portion of the apparel shown in FIG. 6 an auxiliary pocket-like compartment is also shown.

FIG. 6 is a side view of the apparel embodiment as worn by the apparel wearer in FIGS. 4 and 5. A hidden storage compartment 12 is shown extending downwardly from an auxiliary interior waistband 22, and may alternatively be suspended from another interior-facing portion of the apparel, and is depicted having one or more stored item(s) 36 stored therein. The side view of FIG. 6 illustrates the option of the compartment 12 having a length such that the positioning of items contained therein can be suspended at a height which takes advantage of the profile contour of the body 58 just below the lower buttocks 30 and upper rear portion of the legs 32 (the compartment, stored item, lower buttocks and upper legs are shown in dashed lines). By so doing, the compartment length as depicted optimally conceals the bulk or size of the stored items in an 'Out of Sight-Out of Mind' manner.

FIGS. 7 through 12 depict an embodiment of the invention having the appearance of a conventional sleeved-like garment 48 and also comprising the same internally attached, or attachable, components as the skirt-like or sarong-like apparel depicted in FIGS. 1 through 6. The sleeved-like garment 48 shown in FIGS. 7 through 12 has two sleeve-like members 52 each of which functions as a tieable member 18 similar to the functionality of members 18 previously described.

The interior (inside) view of FIG. 7 shows a concealed storage compartment 12 for the storage of transportable items and is depicted being attached adjacent to a lower edge of a auxiliary interior waistband 22 which preferably has fastening means 26 and optional auxiliary fastener members 24 (similar to those previously described in FIGS. 1 and 2) for securing the apparel to one's waist.

The exterior (outside) view of FIG. 8 shows a concealed storage compartment 12, stored item(s), auxiliary interior waistband 22 and fastening means in dashed lines to indicate a positioning of those components on the opposite side of the apparel. Optionally, the sleeved-like garment 48 includes an actual or (faux) simulated collar 56.

It is noted that while only one storage compartment 12 is shown attached adjacent to, or otherwise suspended from, the interior surface 20 of apparel 10 in FIG. 7, that optionally a plurality of compartments may instead be similarly attached to the apparel and occupy the storage volume previously described in a manner wherein the stored items or valuables will not be detectable to observers of the apparel. The concealed storage compartment(s) 12 can have any in a variety of sizes and/or shapes and have at least one opening preferably equipped with a fastening means such as a zipper 38 having a zipper slider 44, for securing items safely in the compartment(s). Preferably the opening(s) on the compartment(s) is located so as to provide optimal ease-of-access to the wearer of the apparel. For example, the opening solely, or with an optional fastening means such as zipper 38, may be located near an upper outward-facing portion of the compartment such that when the wearer wishes to store or retrieve any items, he or she simply rotates the apparel partially around his or her waist and raises the garment body 50 of the apparel (shown in FIGS. 7 and 8) upward to reveal the opening and to provide easy access thereto, or to an optional opening having a zipper or other separable fastening means.

Preferably, the apparel fastening means 26 depicted in FIGS. 7 and 8 are each attached adjacent to an end of an auxiliary fastener member 24 and the latter is preferably equipped with easy adjustment means such as a strap-length adjusters for increasing or decreasing the operative length of member(s) 24 as needed or desired by a wearer of the waist-fastening apparel 10. Such adjustments can allow for a slip-fit around the waist, for example, to facilitate rotation of the apparel for easy access to one or more compartments. Moreover, such easy adjustments of the waist-fastening means readily accommodates changes in the size of a wearer of the apparel for example if the wearer should gain or lose any weight.

To optimally simulate the look of a sleeved-like garment or apparel having faux sleeves with waist-tying functionality, each tieable member 18 is comprised of a sleeve-like member 52 which extends outwardly beyond the garment body 50. Preferably, the tieable members 18 are positioned such that when they are tied together, they conceal auxiliary interior waistband 22, auxiliary fastener members 24 and fastening means 26. In combination, the latter internal components bear the weight of the apparel and any storable items transported in one or more compartments 12. Thus, the unburdened sleeve-like members 52 tend to remain tied until a wearer of the apparel wishes to untie them, eliminating a common annoyance associated with sleeved garments coming untied from one's waist.

Alternatively, a similar embodiment incorporates actual sleeved apparel wherein the previously described internal components of FIGS. 7 and 8 are attachable to an external side of a sleeved apparel, for example, in a back-pouch or back-pack manner, or in a belly-pouch or belly-pack manner, or in the case of conventional garments worn about the waist are attachable to an external side of such apparel, for example, in a 'fanny-pack' or belly-pack manner. Optionally, the belly-pack or belly-pouch embodiments can be attached to form a two-sided pocket such that a wearer can insert his or her hands through side openings behind the pack and in front of the flexible apparel material covered by the pack or pouch. Preferably, in each case, the internal components depicted in FIGS. 7 and 8 are releasably attachable from the conventional garments and are separately wearable, and subsequently re-attachable to one or more different types of conventional garments using any one or more of the aforementioned types of apparel-related fastening means.

As previously mentioned, one or more portions of the apparel can include advertising, which may include, and is not limited to, the name or indicia of a health club, resort or gym, or trademark, service mark or the brand name of an apparel maker. For example, the largest contiguous surface of the waist-fastening apparel is the portion which drapes over the lower back, buttocks and upper legs of a wearer. This portion can easily be seen by observers, including at a distance, when a wearer of the apparel is faced away from, or is walking away from the observer. Thus, it would be advantageous for a valuables security-enhancing wrap-around apparel having a large display area to also display advertising, promotional or cross-promotional content or to have one or more type of indicia placed in this area, or any other area of the apparel that is easily viewable by one or more observers when the apparel is worn by a wearer. Preferably any observer discernible content, readable language or indicia which is typically read or best understood when rotated to a right-reading orientation is also displayed on the apparel of the present invention so as to appear in a right-reading orientation when worn by a wearer.

The exterior (outside) view of FIG. 8 shows the compartment 12, stored item(s) 36, auxiliary interior waistband 22 fastening means 26 and optional auxiliary fastener members 24 in dashed lines as a means for indicating a positioning of those components on the opposite/interior side of the apparel. These components are not viewable from the exterior side of the apparel.

Figure 10:
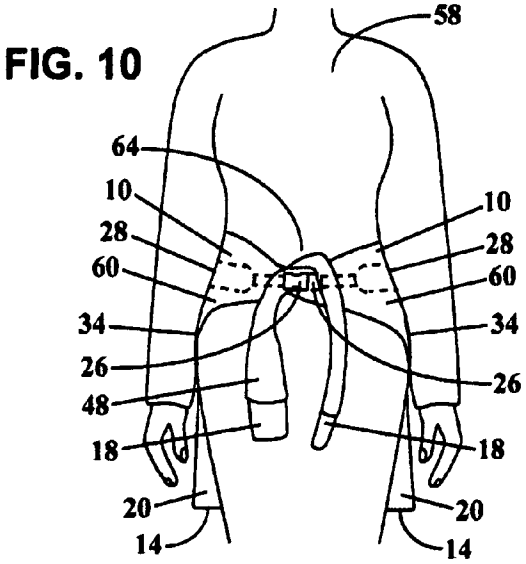
FIG. 10 is a two-dimensional front view, similar to that of FIG. 9 wherein the tieable sleeve-like members have been pulled taught around the hips and waist of the wearer and tied, to create the appearance of a tied sleeved-like garment. The view shows the waistband-like member and fastening means in dashed lines to indicate a positioning of those components on the opposite, interior side of the apparel.
Figure 12:
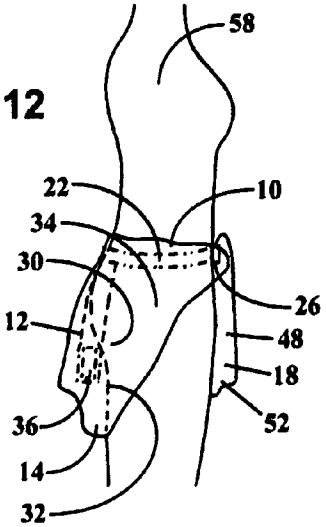
FIG. 12 is a side view of the apparel as worn by the apparel wearer in FIGS. 10 and 11. A compartment, stored item(s), waistband-like member and fastening means are depicted in dashed lines as a means for indicating a preferred positioning of those components.
Figure 9:
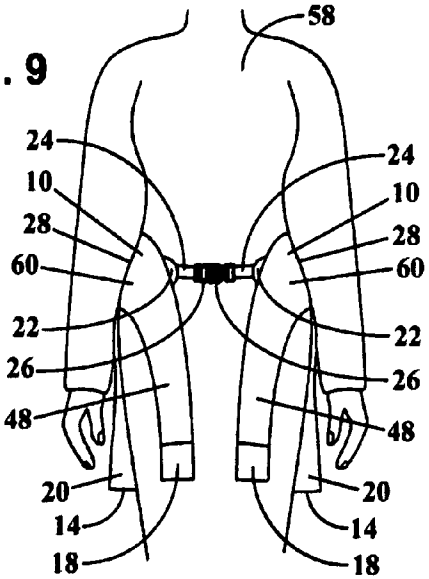
FIG. 9 is a two-dimensional front view of a sleeved-like garment embodiment of the invention as it would appear secured to the waist of a wearer by the invention's fastening means, before the tieable members of the apparel have been tied.
Figure 11:
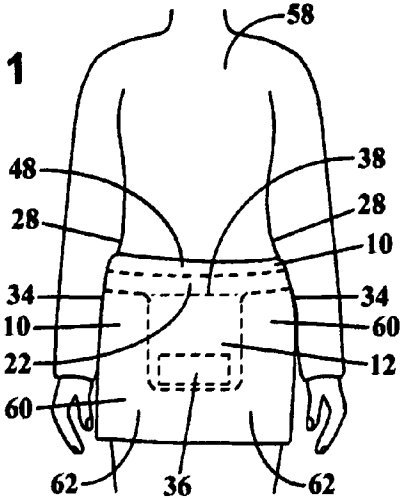
FIG. 11 is a two-dimensional rear view of the apparel and apparel wearer depicted in FIG. 10. The compartment, stored item(s), waistband-like member and fastening means shown in dashed lines in FIG. 8 are similarly depicted in FIG. 11 as a means for indicating a positioning of those components on the opposite, interior side of the apparel.

In reference to the operation of the embodiment depicted in FIGS. 7 through 12, a wearer of the apparel 10 will typically loosen the apparel's fastening means, or alternatively stretch elastic or stretchable waistband material, to allow a rotation of the apparel about the waist. Thus, the auxiliary interior waistband 22 is positionable on the wearer's waist 28 as shown in FIG. 9 such that the storage compartment attached thereto will be positioned as depicted in FIGS. 11 and 12 within the 3D storage volume as previously described (see also FIGS. 13A-13G). Thus, the apparel 10 will be centered and the optional fastening means 26 will be connected in a central area of the belly as depicted in FIG. 9 (or a region of the stomach 64 as shown in FIG. 10). Preferably, he or she will have adjusted the length of the auxiliary fastener member(s) 24 as needed so that when the fastening means 26 are secured, the apparel will be comfortably fastened at the waist. Preferably, the wearer will take the two tieable members 18 consisting of two sleeve-like members 52, and secure them together as shown in FIG. 10, in a customary sleeved-garment manner which also hides the optional fastening means 26 and the ends of the optional auxiliary fastener member(s) 24 if needed.

Preferably adjustments made to the length of the auxiliary fastener member(s) 24 are such that when the fastening means 26 are secured together, there is sufficient play between the auxiliary interior waistband 22 and the wearer's waist to provide quick access to, or a re-centering of, one or more hidden compartments by rotating the apparel partially around the wearer's waist. To quickly remove the apparel when desired, the wearer simply unties the two sleeve-like members 52 and separates optional fastening means 26 if the latter are also employed. Preferably means 26 are equipped with a quick-release and/or quick-attaching mechanism(s). Fastening means 26 may include any one or more of the types of apparel, garment and recreational clothing fastening means previously described.

The embodiment of the invention depicted in FIGS. 7 and 8 can be adapted to incorporate the optional dual-purpose or multi-purpose embodiments of the apparel shown in FIGS. 1 and 2, wherein auxiliary interior waistband 22 auxiliary fastener members 24 and fastening means 26, or any combination thereof, can be attached, separably or releasably fastened to the apparel, or to conventional apparel, and can be selectively removed to provide several options: (1) to provide exchangeable components that can be fastened to other sleeved-like garments, or actual sleeved garments, that are sold without the interior components and are equipped with standardized fastening means which accept, or are correctly matched with or to, the fastening means of the exchangeable components; (2) to provide a means whereby one or more portions or components of the apparel can be washed or dry-cleaned separate from one or more other components; (3) to provide a means whereby a wearer can optionally employ the waistband 22, auxiliary fastener members 24 and fastening means 26 in a 'fanny pack' type of manner without the sleeved-like garment 48 or actual sleeved garment; and (4) to provide a means whereby a wearer can optionally where just an actual sleeved which has been separated from the waistband 22, auxiliary fastener members 24 and fastening means.

FIG. 9 is a two-dimensional front view of a sleeved-like garment 48 embodiment of the invention as it would appear secured to the waist 28 above the area of the hip 34 on a female body 58 by the invention's fastening means, before the tying of the sleeve-like members 52, or sleeves of an actual sleeved garment which is adapted to incorporates the waist-fastening components of the apparel 10. In FIG. 9, the tieable members 18 are shown hanging downward prior to a tying of members 18. For the purposes of further describing the embodiments of the apparel having sleeve-like members or the sleeves of an actual sleeved garment, the simulated sleeved variant having sleeve-like members 18 will be used.

FIG. 10 is a two-dimensional front view, similar to that of FIG. 9 wherein the tieable members 18 have been pulled taught around the waist 28 above the area of the hip 34 on a female body 58 and tied.

FIG. 11 is a two-dimensional rear view of the apparel 10 and apparel wearer depicted in FIG. 10. The largest contiguously shown surface of the waist-fastening apparel is depicted in FIG. 11 and is the garment body 50 of the apparel which extends downwardly from the waist over the lower back, the buttocks and upper rear portion of the legs 32 (see also FIG. 12) of a wearer. The hidden storage compartment 12, stored item(s) 36, waistband-like member 22 are shown in dashed lines indicating a positioning of those components on the opposite, interior side of the apparel.

FIG. 12 is a side view of the sleeved-like garment as worn by the apparel wearer in FIGS. 10 and 11. A hidden storage compartment 12 is shown extending downwardly from an auxiliary interior waistband 22 and has one or more stored item(s) 36 stored therein. The side view of FIG. 12 illustrates the option of the compartment 12 having a length such that the positioning of items contained therein can be suspended at a height which takes advantage of the profile contour of the body 58 just below the lower buttocks 30 and upper rear portion of the legs 32 (the compartment, stored item, lower buttocks and upper legs are shown in dashed lines). By so doing, the compartment length as depicted optimally conceals the bulk and/or size of the stored items in an 'Out of Sight-Out of Mind' manner such that the items are not detectable at the surface of the apparel to observers.

Figure 13A:
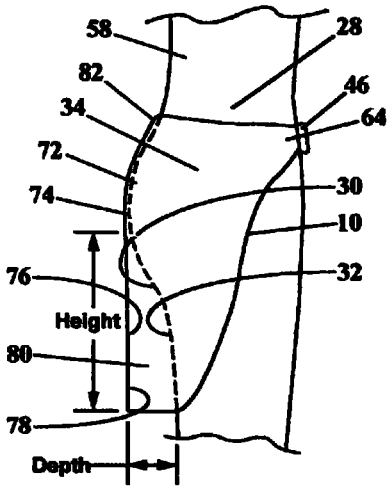
FIGS. 13A through 13D are side view depictions of a storage volume or storage capacity defined within the inward-facing surface of an apparel lower rear portion and outward-facing surface contours of a body in the rear upper leg region below the buttocks.
Figure 13B:
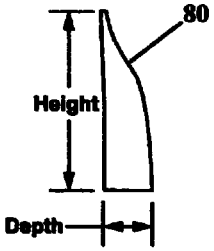
Figure 13C:
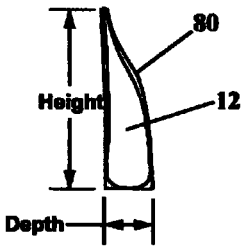
Figure 13D:
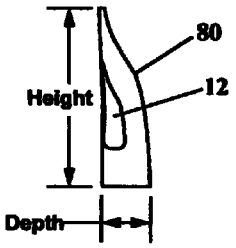
Figure 13E:
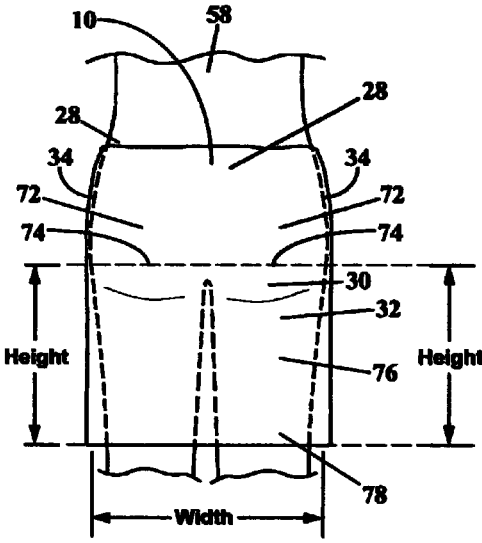
FIGS. 13E and 13F are rear views corresponding to the storage volume or storage capacity depicted in the side views of FIGS. 13A through 13D.
Figure 13F:
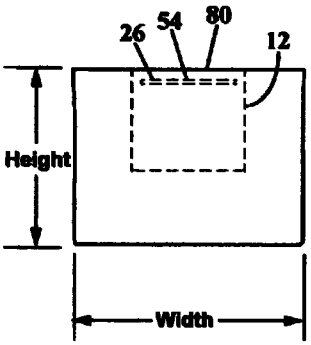
Figure 13G:
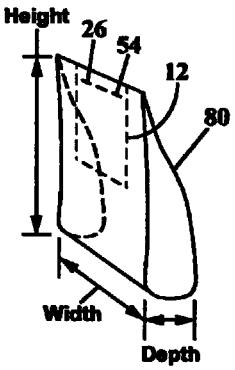
FIG. 13G is a three-dimensional view corresponding to the storage volume or storage capacity depicted in the side views of FIGS. 13A through 13D and the rear views depicted in FIGS. 13E and 13F.

In reference to the remaining FIGS. 13A through 13G, FIGS. 13A through 13D depict side views of an optimum or maximum storage volume 80 which is defined in three dimensions by a rear apparel portion 76 shown in FIG. 13A which extends downwardly in a freely-suspended manner past the wearer's buttocks 72 to define a concealed three-dimensional (3D) storage volume 80 proximate to an upper rear portion of the legs 32. The concealed 3D volume has a height dimension extending upwardly from an apparel rear lower portion 78 to a point proximate to a rearward-most portion of the wearer's buttocks 74 or to the lower buttocks region 30, a width dimension up to that of the width of the wearer's buttock's as depicted in FIGS. 13E through 13G, and a depth dimension being defined between a lower inward-facing interior surface of the rear apparel portion 76 and rearward-facing surface contours of the wearer's body below the rearward-most portion of the wearer's buttocks such as the upper rear portion of the wearer's legs 32. Suspended from an interior portion of the wrap-around garment body of apparel 10 is at least one fully-concealed storage compartment 12 having a three-dimensional storage capacity up to that of the 3D storage volume 80 for securely storing and concealing valuables within the 3D volume in an out-of-sight, out-of-mind manner, so as to be undetectable by observers, and whereby the outer surface or exterior appearance of the apparel is not altered by any stored valuables. It is noted that while a single hidden storage compartment 12 is shown in FIGS. 13A through 13G, that alternatively one or more compartments 12 can instead by employed anywhere within the three dimensional limits of storage volume 80.

Although the present invention has been described with a certain degree of particularity, it is understood that the present disclosure has been made by way of example, and changes in detail or structure may be made without departing from the spirit of the invention in the previous descriptions or as defined in appended claims.

The invention claimed is:

1. Dual-waistbanded garment with enhanced-security interiorly-concealed waistband bearing a pouch with a freely-suspending lower depth-expandable pouch portion, comprising:

an exterior waistband with elongate outer end portions configured having a size and shape typical of an upper widthwise and upper central portion of a common type of garment, wherein the elongate outer end portions of the exterior waistband are of sufficient length to detachably tie together such that cross-wise portions thereof partially retain the dual-waistbanded garment fully about a waist of a user while aligned over and concealing fastened detachable ends of an interior waistband;

a remainder lower portion, typical of a lower portion of the common type of garment, configured extending downwardly from a reduced-width lower portion of the upper widthwise portion;

said interior waistband configured having a downwardly extending pouch suspending separate from and proximate a generally forward-facing interior surface of said remainder lower portion;

the interior waistband further configured secured, or detachably securable, along an upper interior-facing side of the dual-waistbanded garment, such that, the interior waistband is entirely concealed by said exterior waistband and said cross-wise portions when the dual-waistbanded garment is worn by a user;

detachably fastenable ends of the interior waistband configured to attach, about the waist of a user, the dual-waistbanded garment and said downwardly extending pouch;

the downwardly-extending pouch further comprising a freely-suspending pouch lower portion and a selectively openable and closable opening, wherein, during a wearing of the dual-waistbanded garment the opening is hidden from view and configured accessible by a user by a positioning of a portion of the garment which reveals the opening such that one or more three-dimensional objects are movable therein and removable therefrom; and, said freely-suspending pouch lower portion of said downwardly-extending pouch configured unimpededly and imperceptibly expandable within a concealed three-dimensional volume located intermediate the separate generally forward-facing interior surface of the remainder lower portion and generally upper rearward-facing portions of a user's legs, such that an enhanced-security containing of one or more three-dimensional objects, within said pouch lower portion, of a size not exceeding the concealed three-dimensional volume, is provided in a manner not altering the exterior surface of the dual-waistbanded garment.

2. The dual-waistbanded garment of claim 1, wherein said freely-suspending pouch lower portion extending downwardly from the concealed interior waistband, and configured unimpededly and imperceptibly expandable within said hidden three-dimensional volume, is configured having a width equal to or greater than a majority body-width portion of a user.

3. The dual-waistbanded garment of claim 1, wherein at least one of the interior waistband outer end portions configured detachably fastenable is further configured length-adjustable and to align concealed behind at least one of the elongate outer end portions of said exterior waistband, and such that a user can quickly adjust the effective or operative length and the fit of the interior waistband when worn about the waist of the user, by a length adjustment being made to the at least one length-adjustable outer end portion.

4. The dual-waistbanded garment of claim 3, further comprising said interior waistband and downwardly extending pouch configured selectively rotatable about a waist of a user between a normal pouch-hidden position and a pouch-opening position accessible at or near the front of a user, wherein:

a first, snug-fit adjustment made to at least one length-adjustable outer end of the interior waistband, provides a positive securing of the dual-waistbanded garment about the waist of the user while bearing the weight of one or more three-dimensional objects contained in said freely-suspending pouch lower portion in a first normally rotated position, and such that the pouch lower portion is aligned unimpededly and imperceptibly expanded within said three-dimensional volume; and, a second, loose-fit adjustment made to at least one length-adjustable outer end of the interior waistband, allows the dual-waistbanded garment and pouch to be readily rotated about the waist of the user to at least a second rotated position, wherein the pouch opening is located accessible at or near the front of the user such that one or more three-dimensional objects can readily be placed within and/or removed from the pouch.

5. The dual-waistbanded garment of claim 4, wherein said loose-fit adjustment made to at least one length-adjustable outer end of the interior waistband further allows the dual-waistbanded garment and pouch to be readily rotated about the waist of the user back to said first normally rotated position, such that, a snug-fit adjustment made to at least one length-adjustable outer end of the interior waistband, provides a positive securing of the dual-waistbanded garment and the freely-suspending pouch about the waist of the user in the first normally rotated position, and such that an interior waistband outer end portion configured length-adjustable is aligned concealed behind at least one of the elongate outer end portions of said exterior waistband.

6. The dual-waistbanded garment of claim 1, wherein said remainder lower portion is configured having a size and shape typical of a lower portion of a common waist-fastened type of garment selected from a group consisting of: a skirt, a sarong, and a wrap-around garment; and, said common waist-fastened type of garment of sufficient width to extend entirely around a waist of a user such that at least a majority portion of a first generally upright perimeter-side of said lower portion overlaps an opposite second generally upright perimeter-side.

7. The dual-waistbanded garment of claim 1, wherein said remainder lower portion securable about a waist of a user by the concealed interior waistband, is configured having a size and shape typical of a lower portion of a common long-sleeved type of garment selected from a group consisting of: a shirt, a sweater, a jacket, a sweatshirt, and a coat; and, the exterior waistband and respective cross-wise portions of the elongate outer end portions which align over and conceal elongate central and fastened end portions of the interior waistband, are configured having a size and shape typical of an upper widthwise portion of a same selected one of the common long-sleeved type of garment group.

8. The dual-waistbanded garment of claim 1, wherein the exterior waistband and respective cross-wise portions of the elongate outer end portions which align over and conceal elongate central and fastened end portions of the interior waistband, are configured to have a likeness of an upper portion of a common long-sleeved type of garment selected from a group consisting of: a shirt, a sweater, a jacket, a sweatshirt, and a coat; and, said remainder lower portion securable about a waist of a user by a fastening of the outer end portions of the concealed interior waistband, is sized and shaped to have a likeness typical of a lower portion of a same selected one of the common long-sleeved type of garment group.

9. The dual-waistbanded garment of claim 8, wherein each elongate outer end portion of the exterior waistband is a faux long-sleeve having a size, shape and appearance of an actual long-sleeve of a common long-sleeved type of garment.

10. The dual-waistbanded garment of claim 1, wherein said remainder lower portion is configured having a size and shape typical of a lower portion of a common waist-fastened type of garment selected from a group consisting of: a skirt, a sarong, and a wrap-around garment; and, the exterior waistband and respective cross-wise portions of the elongate outer end portions which align over and conceal elongate central and fastened end portions of the interior waistband, are configured having a size and shape typical of an upper portion of a same selected one of the common waist-fastened type of garment group.

11. The dual-waistbanded garment of claim 1, wherein each elongate outer end portion of an exterior waistband is a sleeve principally normally-proportioned in length and tapered lengthwise such that an end portion or cuffed portion of the sleeve is narrower than a shoulder-proximate portion.

12. The dual-waistbanded garment of claim 1, wherein each elongate outer end portion of an exterior waistband is configured having at least one non-tapered elongate perimeter-side.

13. The dual-waistbanded garment of claim 1, wherein the interior waistband and downwardly extending pouch are configured detachably securable and concealable along an interior-facing side of the dual-waistbanded garment, such that, the interior waistband and downwardly extending pouch are selectively wearable separate from the dual-waistbanded garment when detached, and subsequently re-attachable along the upper interior-facing side of the same dual-waistbanded garment or attachable along an upper interior-facing side of a different dual-waistbanded garment.

14. The dual-waistbanded garment of claim 1, wherein said detachably fastenable ends of the interior waistband are configured fastenable together by suitable fastening means or quick-fastening means.

15. The dual-waistbanded garment of claim 1, further comprising the interior waistband and downwardly extending pouch being configured detachably securable and concealable along an interior-facing side of the dual-waistbanded garment by a separable zipper, wherein, a first elongate half of the separable zipper is fastened along an interior-facing side of the dual-waistbanded garment, and a second elongate half of the separable zipper is fastened along a side of the interior waistband, such that, a zipper slider configured to engage the two zipper halves when slid.

16. The dual-waistbanded garment of claim 1, further comprising the interior waistband and downwardly extending pouch being configured detachably securable and concealable along an interior-facing side of the dual-waistbanded garment by suitable fastening means.

17. The dual-waistbanded garment of claim 1, wherein said detachably fastenable ends of the interior waistband are configured fastenable together by suitable quick-fastening means in a manner concealable behind the cross-wise portions of said exterior waistband and/or upper overlapping end portions of a wrap-around garment.

18. The dual-waistbanded garment of claim 1, wherein said three-dimensional volume has a height dimension principally extending between upper rearward-facing portions of a user's legs and proximate a lower perimeter of a freely suspending remainder lower portion worn by a user.

19. The dual-waistbanded garment of claim 1, wherein said three-dimensional volume has a width-dimension generally approximating the width of a freely suspending remainder lower portion worn by a user.

20. The dual-waistbanded garment of claim 1, wherein said three-dimensional volume has a depth-dimension principally extending between upper rearward-facing portions of a user's legs and the generally forward-facing interior surface of said remainder lower portion when worn by a user.

21. The dual-waistbanded garment of claim 1, wherein the exterior waistband with elongate outer end portions typical of an upper widthwise portion of a common type of garment, and the remainder lower portion, typical of a lower portion of a common type of garment, configured extending downwardly from a reduced-width lower portion of the upper widthwise portion, are portions of a conventional item of apparel; and wherein, the interior waistband with the downwardly-extending pouch and freely-suspending pouch lower portion are configured detachably securable and concealable along an upper interior-facing side of the dual-waistbanded garment by one or more suitable fasteners.

22. The dual-waistbanded garment of claim 1, further comprising at least two pouches configured freely suspending from the interior waistband and concealed within a hidden three-dimensional storage volume located between rearward-facing upper portions of the legs of a user and an interior-facing surface of a freely suspending apparel rear portion, such that, the dual-waistbanded garment external surface is not altered or affected by the bulk of one or more pouch-contained three-dimensional objects.

23. Dual-waistbanded garment with enhanced-security interiorly-concealed waistband bearing a pouch and freely suspending lower depth-expandable pouch portion, comprising:

an exterior waistband with elongate outer end portions configured having a size and shape typical of an upper widthwise and upper central portion of a common type of garment, wherein the elongate outer end portions of the exterior waistband are of sufficient length to detachably tie together such that cross-wise portions thereof partially retain the dual-waistbanded garment fully about a waist of a user while aligned over and concealing detachably fastenable ends of an interior waistband;

a remainder lower portion, typical of a lower portion of the common type of garment, configured extending downwardly from a reduced-width lower portion of the upper widthwise portion;

said interior waistband configured having a downwardly extending pouch suspending separate from and proximate a generally forward-facing interior surface of said remainder lower portion;

the interior waistband further configured secured along an upper interior-facing side of the dual-waistbanded garment, such that, the interior waistband is entirely concealed by said exterior waistband and said cross-wise portions when the dual-waistbanded garment is worn by a user;

detachably fastenable ends of the interior waistband configured to attach about the waist of a user the dual-waistbanded garment and said downwardly extending pouch;

the downwardly-extending pouch further comprising a freely-suspending pouch lower portion and a selectively openable and closable opening, wherein, during a wearing of the dual-waistbanded garment the opening is hidden from view and configured accessible by a user by a positioning of a portion of the garment which reveals the opening such that one or more three-dimensional objects are movable therein and removable therefrom; and, said freely-suspending pouch lower portion of said downwardly-extending pouch configured unimpededly and imperceptibly expandable within a concealed three-dimensional volume located intermediate the separate generally forward-facing interior surface of the remainder lower portion and generally upper rearward-facing portions of a user's legs, such that an enhanced-security containing of one or more three-dimensional objects, within said pouch lower portion, of a size not exceeding the concealed three-dimensional volume is provided in a manner not altering the exterior surface of the dual-waistbanded garment.

24. Dual-waistbanded garment with enhanced-security interiorly-concealed waistband bearing a pouch and freely suspending lower depth-expandable pouch portion, comprising:

an exterior waistband with elongate outer end portions configured having a size and shape typical of an upper widthwise and upper central portion of a common type of garment, wherein the elongate outer end portions of the exterior waistband are of sufficient length to detachably tie together such that cross-wise portions thereof partially retain the dual-waistbanded garment fully about a waist of a user while aligned over and concealing detachably fastenable ends of an interior waistband;

a remainder lower portion, typical of a lower portion of the common type of garment, configured extending downwardly from a reduced-width lower portion of the upper widthwise portion;

said interior waistband configured having a downwardly extending pouch suspending separate from and proximate a generally forward-facing interior surface of said remainder lower portion;

the interior waistband further configured detachably securable along an upper interior-facing side of the dual-waistbanded garment, such that, such that, the interior waistband is entirely concealed by said exterior waistband and said cross-wise portions when the dual-waistbanded garment is worn by a user;

detachably fastenable ends of the interior waistband configured to attach about the waist of a user the dual-waistbanded garment and said downwardly extending pouch;

the downwardly-extending pouch further comprising a freely-suspending pouch lower portion and a selectively openable and closable opening, wherein, during a wearing of the dual-waistbanded garment the opening is hidden from view and configured accessible by a user by a positioning of a portion of the garment which reveals the opening such that one or more three-dimensional objects are movable therein and removable therefrom; and, said freely-suspending pouch lower portion of said downwardly-extending pouch configured unimpededly and imperceptibly expandable within a concealed three-dimensional volume located intermediate the separate generally forward-facing interior surface of the remainder lower portion and generally upper rearward-facing portions of a user's legs, such that an enhanced-security containing of one or more three-dimensional objects, within said pouch lower portion, of a size not exceeding the concealed three-dimensional volume is provided in a manner not altering the exterior surface of the dual-waistbanded garment.

* * * * *